US008988302B2

(12) United States Patent
Petersson et al.

(10) Patent No.: US 8,988,302 B2
(45) Date of Patent: Mar. 24, 2015

(54) ANTENNA ARRANGEMENTS

(75) Inventors: Sven Petersson, Savedalen (SE); Martin Johansson, Molndal (SE); Stefan Johansson, Romelanda (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 538 days.

(21) Appl. No.: 13/257,726

(22) PCT Filed: Mar. 23, 2009

(86) PCT No.: PCT/EP2009/053360

§ 371 (c)(1),
(2), (4) Date: Sep. 20, 2011

(87) PCT Pub. No.: WO2010/108534

PCT Pub. Date: Sep. 30, 2010

(65) Prior Publication Data

US 2012/0007789 A1 Jan. 12, 2012

(51) Int. Cl.
*H01Q 21/26* (2006.01)
*H01Q 19/00* (2006.01)
(Continued)

(52) U.S. Cl.
CPC ..... *H01Q 21/24* (2013.01); *H01Q 1/246* (2013.01)
USPC ..... 343/797; 343/756

(58) Field of Classification Search
USPC ..... 343/797, 756, 853, 856, 798
See application file for complete search history.

(56) References Cited

U.S. PATENT DOCUMENTS 5,966,102 A * 10/1999 Runyon ..... 343/820
6,144,339 A 11/2000 Matsumoto et al.
6,377,558 B1 * 4/2002 Dent ..... 370/321
(Continued)

FOREIGN PATENT DOCUMENTS

CN 1273463 A 11/2000
CN 1304567 A 7/2001
(Continued)

OTHER PUBLICATIONS

Office Action issued in corresponding Chinese application No. 200980158359.9 on Jun. 5, 2013, 18 pages.
(Continued)

*Primary Examiner* — Hoang V Nguyen
*Assistant Examiner* — Patrick Holecek
(74) *Attorney, Agent, or Firm* — Rothwell, Figg, Ernst & Manbeck P.C.

(57) ABSTRACT

The present invention relates to an antenna arrangement (100) comprising an antenna part comprising at least two antenna means, each with a number of first antenna elements having a first polarization and a number of second antenna elements having a second polarization different from said first polarization, said antenna part further comprising antenna part ports. There are two antenna part ports for each antenna means, one antenna part port for each polarization, and the antenna arrangement (100) further comprises polarization controlling means (30), comprising a distribution network, to which the antenna part ports are connected, and which includes at least a main forming network with external interface antenna ports ($\mathbf{30}_1$,$\mathbf{30}_2$,$\mathbf{30}_3$,$\mathbf{30}_4$). The polarization controlling means (30) is configured to connect antenna part ports and external interface antenna ports ($\mathbf{30}_1$, $\mathbf{30}_2$, $\mathbf{30}_3$, $\mathbf{30}_4$).

28 Claims, 12 Drawing Sheets

(51) Int. Cl.
*H01Q 21/24* (2006.01)
*H01Q 1/24* (2006.01)

(56) References Cited

U.S. PATENT DOCUMENTS

| | | | | |
|---|---|---|---|---|
| 6,943,732 | B2 * | 9/2005 | Gotti et al. | 343/700 MS |
| 2002/0132600 | A1 | 9/2002 | Rudrapatna | |
| 2006/0068848 | A1 * | 3/2006 | Shapira et al. | 455/562.1 |
| 2008/0204318 | A1 | 8/2008 | Thomas et al. | |
| 2008/0246663 | A1 * | 10/2008 | Fox | 342/373 |

FOREIGN PATENT DOCUMENTS

| | | | |
|---|---|---|---|
| CN | 1921341 | A | 2/2007 |
| JP | 2002-057515 | A | 2/2002 |
| JP | 2004-200869 | A | 7/2004 |
| WO | 9722159 | A1 | 6/1997 |
| WO | 2004068721 | A2 | 8/2004 |
| WO | 2006136793 | A1 | 12/2006 |

OTHER PUBLICATIONS

Office Action issued in corresponding Japanese application No. 2012-501142 on Aug. 6, 2013, with Summary of Ground for Rejection, 4 pages.

State Intellectual Property Office of People's Republic of China Supplementary Search Report and English Translation of Third Office Action dated Mar. 14, 2014, Chinese Application No. 200980158359.9, Applicant: Telefonaktiebolaget L M Ericcson (Publ), 10 pages.

Search Report of Fourth Office Action dated Sep. 25, 2014, CN Application No. 200980158359.9, Filing Date: Mar. 23, 2009, Applicant: Telefonaktiebolaget L M Ericsson (Publ), 3 pages.

Fourth Office Action form, CN Application No. 200980158359.9, Filing Date: Mar. 23, 2009, Applicant: Telefonaktiebolaget L M Ericsson (Publ), Title: Antenna Arrangements, 3 pages.

English Translation of Fourth Office Action, CN Application No. 200980158359.9, Filing Date: Mar. 23, 2009, Applicant: Telefonaktiebolaget L M Ericsson (Publ), 7 pages.

* cited by examiner

STATE OF THE ART

ANTENNA ARRANGEMENTS

CROSS-REFERENCE TO RELATED APPLICATION

This application is a 35 U.S.C. §371 National Phase Entry Application from PCT/EP2009/053360, filed Mar. 23, 2009, and designating the United States.

TECHNICAL FIELD

The present invention relates to an antenna arrangement with an antenna part which comprises at least two antenna means. Each antenna means comprises first and second antenna elements with different polarizations and antenna part ports. The invention also relates to an antenna system comprising such antenna arrangements and to a method for controlling at least one characteristic of such an antenna arrangement.

BACKGROUND

For a conventional antenna the polarization properties are substantially identical for spatial directions, at least within the main lobe of the antenna. This means for example that a sector antenna which is vertically polarized is substantially vertically polarized for all directions constituting the desired sector coverage.

It has become attractive to provide reconfigurable antenna systems, among other things in order to provide power efficient site installations. If for example an antenna system at a site is configured for three sector operation during busy hours with a high traffic load, it can be reconfigured for omnidirectional (one sector) operation when traffic load is low. The purpose of performing a reconfiguration is to allow partial shut down base station equipment in order to save energy. FIGS. 1A and 1B very schematically illustrate the radiation patterns (main beams) and signals corresponding to an arrangement in which three different signals S1, S2, S3 are fed via separate transmitter chains to one sector antenna each, hence representing a first configuration state for high traffic load. After reconfiguration to a second state for low traffic load, the three transmitter chains are combined in that only one signal OS, e.g. from one of the transmitter chains in a distribution network DN, by means of power splitting is split into three identical signals $OS_1$, $OS_2$, $OS_3$ which are fed to multiple antennas, for example the three antennas referred to above. These signals will then interact, resulting in coherent and/or non coherent beam-forming depending on antenna polarizations.

If the polarization for the electromagnetic fields of the antennas are non-orthogonal, an interaction between the non-orthogonal field components from the different antennas will result that depends on both amplitude and phase of the respective components, also called coherent beam-forming.

This means that the relative positions of the antennas and the effective signal path lengths from the power splitter DN to the antennas will have an impact on the resulting radiation pattern. If the radiated field components of the three identical, multiple signals are orthogonal, the power of the combined field of the three field components is the sum of the powers of the signals. This power addition is called non coherent beam-forming. Such a non coherent beam-forming results in a different combined radiation pattern as compared to coherent beam-forming. The magnitude of the combined radiation pattern for non-coherent beamforming is independent of the phase values of the signals, i.e. of the antenna positions and signal path lengths, which means that these two properties do not have to be considered during design and installation of an antenna system. The problem is that coherent beam-forming of identical signals from different antennas results in interaction in adjacent sectors, the effects of this interaction being particularly strong for directions in which the radiated power from two or more antennas are of similar magnitude, the effects of the interaction being difficult or impossible to predict without detailed knowledge of access point (site) geometry and phase characteristics of all components being part of the transmitter chains. It has been realized that such an interaction can be reduced by using different, preferably orthogonal polarizations in adjacent sectors. However, in order to be able to use orthogonal polarizations in adjacent sectors to avoid coherent beam-forming, there must be an even number of sectors, when the site is equipped with conventional sector antennas. The situation with a site installation having an odd number of sectors will be described with reference to FIG. 2C, which is a simplified top view of the antenna orientations and radiation pattern polarization states of the arrangement described above, for example in FIG. 1A, 2A.

With the site in a low traffic state configuration, for example realized as shown in FIG. 2B, the same signal OS is provided to all three antennas, here a vertically polarized antenna $v_1$, a vertically polarized antenna $v_2$ and a horizontally polarized antenna $h_1$. Since the number of, conventional, antennas is odd, two adjacent sectors will have identical polarization, and thus coherent beam-forming takes place between signals transmitted from antennas $v_1$ and $v_2$. The coherent beam-forming will affect the resulting radiation patterns, here illustrated as signal vectors (amplitude and phase representation) being added, $|s_{v1}+s_{v2}|^2$. For signals transmitted via $v_2$ and $h_1$ and $v_1$ and $h_1$ respectively the combined radiation pattern (field) is the result of adding the power of the respective radiated signals, $|s_{v1}|^2+|s_{h1}|^2$ and $|s_{v2}|^2+|s_{h1}|^2$, which means that there is no dependence on the positions of the antennas and the signal path lengths. The vector addition that occurs when signals with the same orientation of the electrical field, i.e., the same polarization interact results in large fluctuations in the resulting signal magnitude, especially near sector borders where the signals have about the same magnitudes. In which spatial directions the constructive/destructive combinations occur depends on the relative signal phase To avoid coherent beam-forming, an installation could be provided which has an even number of sectors and in which, conventional, antennas with alternating polarizations are combined when reconfiguration takes place. However, there is always a risk that, when the site is reconfigured, signals are transmitted in adjacent sectors via antennas with the same polarization. This is so because typically there are many feeder cables and the reconfiguration (reconnection) may take place quite far from the antenna It should also be borne in mind that antennas often are located on high masts which means that a physical verification of the cabling is difficult, and time consuming.

SUMMARY

It is a general object of the present invention to provide an antenna arrangement which can be used for providing power efficient base station sites, which particularly may comprise sector antennas. It is also an object of the invention to provide an antenna arrangement, particularly an antenna system comprising a number of such antenna arrangements, for which the exact localisation of involved antennas becomes less critical. It is also an object of the invention to provide an antenna arrangement and an antenna system respectively which is less sensitive to connection mistakes and errors during installation and maintenance. It is a particular object of the invention to provide an antenna arrangement, or an antenna system, for which the polarization can be controlled or set to have desired characteristics or properties, which can be controlled or set to vary in a desired manner within the area covered by the antenna arrangement, or the antenna system, respectively.

Therefore an antenna arrangement as initially referred to is provided. The antenna part has two antenna part ports for each antenna means, one for each polarization thereof. The antenna arrangement also comprises polarization controlling means which comprises a distribution network. The antenna part ports are connected to the polarization controlling means. The polarization controlling means, also called polarization determining or forming means, includes at least a main forming network with external interface antenna ports. The polarization controlling means, particularly the main forming network thereof, is adapted to connect antenna part ports and external interface antenna ports in such a manner that a desired variation in polarization properties of beams associated with said external interface antenna ports can be provided. The polarization controlling means (main forming network) is thus configured and set to introduce a variation in polarization properties. The polarization properties for the antenna arrangement will depend on radiation direction.

A system comprising a number of such antenna arrangements is therefore also provided. Still further a method for controlling at least one characteristic of an antenna arrangement as referred to above is provided.

Through the invention an antenna arrangement and an antenna system respectively is provided for which the polarization properties can be given a selected or desired variation within the region or angular interval covered by the antenna parts of the antenna arrangement, or within the radiation region covered by an antenna part, i.e. the polarization can be determined to have a desired variation as a function of spatial angles.

It is an advantage of the invention that an antenna arrangement is provided for which the polarization properties can be determined in a desired manner. A particular advantage is that it becomes possible to arrange an antenna arrangement at a site without being dependent on it having an even number of sector antennas. It is also an advantage that an antenna arrangement is provided which is easily reconfigurable in the sense that the exact physical locations of antenna parts or antenna means becomes less critical than if conventional sector antennas are used. Particularly it is an advantage that erroneous feeder connections will have less or no impact.

BRIEF DESCRIPTION OF THE DRAWINGS

The invention will in the following be further described, in a non-limiting manner, and with reference to the accompanying drawings, in which.

DETAILED DESCRIPTION

Figure 1A:
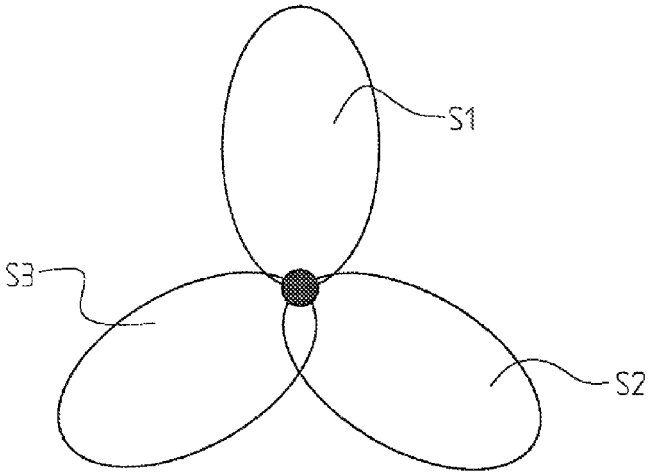
FIG. 1A is an illustration of radiation patterns for a normal three sector antenna system according to the state of the art.
Figure 1B:
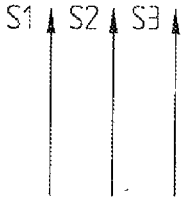
FIG. 1B illustrates different signals, one for each sector, input to the antenna system of FIG. 1A.
Figure 2A:
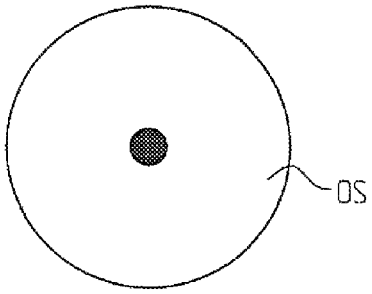
FIG. 2A is an illustration of the radiation pattern when a three sector site, as in FIG. 1A, is reconfigured to an omnidirectional site.
Figure 2B:
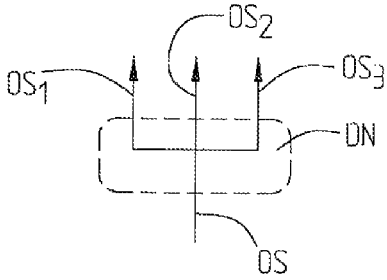
FIG. 2B illustrates an input signal distributed to three antennas.
Figure 2C:
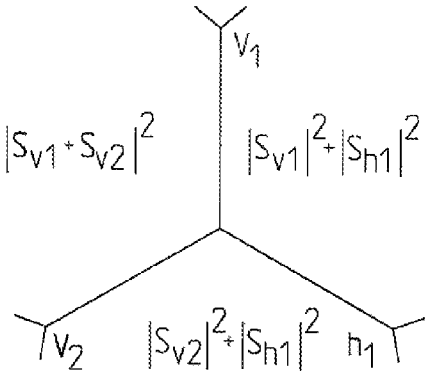
FIG. 2C is a simple view of the three antennas of FIG. 1A and FIG. 2A.
Figure 3:
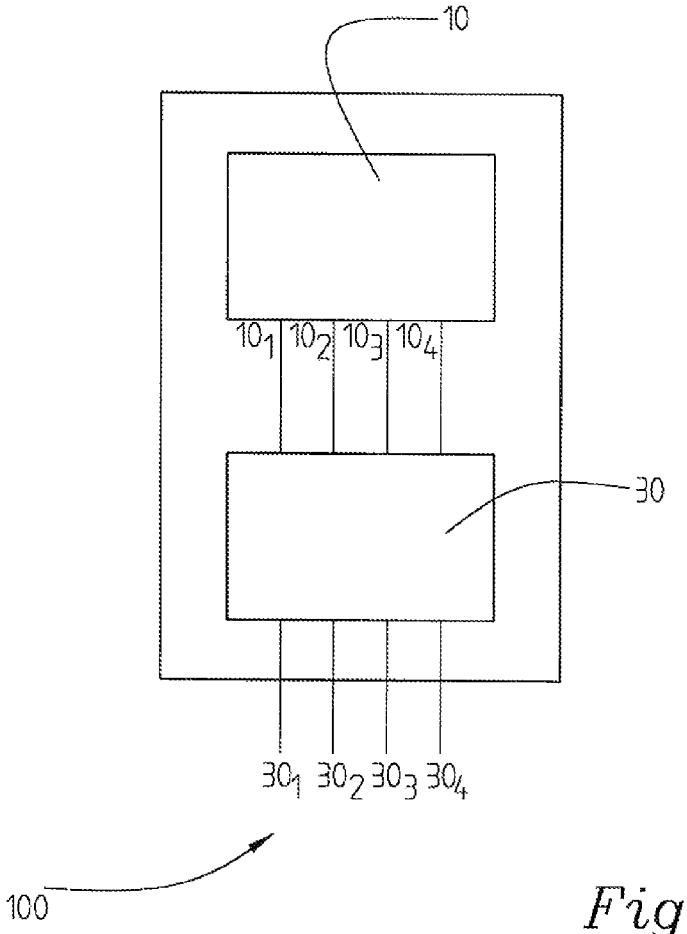
FIG. 3 shows an antenna arrangement comprising an antenna part and a polarization controlling means according to a first embodiment of the present invention.

FIG. 3 shows an antenna arrangement 100 according to one embodiment of the invention. The antenna arrangement comprises an antenna part 10. The antenna part 10 may comprise a so called conventional antenna consisting of one single physical unit with two antenna means or two physical units with each an antenna means. An antenna means is here defined as a functional group comprising a number of first and second antenna elements wherein the first antenna elements have a first polarization and the second antenna elements have a second polarization which is different from said first polarization as will be more thoroughly described below.

The antenna part 10 comprises a plurality of antenna part ports $\mathbf{10}_1$, $\mathbf{10}_2$, $\mathbf{10}_3$, $\mathbf{10}_4$ forming the interface between the antenna part and a polarization controlling means 30 for polarization forming according to the present invention.

It should be noted that for a conventional antenna (here also called antenna part), the polarization associated to an antenna part port is, essentially, invariant with azimuth and elevation angles within the main lobe.

An antenna part port is defined as a physical connection point with which a number of characteristics are associated. In the context of the present invention the following characteristics are relevant; the radiation pattern as a function of angle, the radiation pattern phase as a function of angle, radiation pattern polarization as a function of angle and location in space as given by the position of the phase center. The phase center is herein defined as the particular phase reference point which minimizes the phase variation of the co-polar farfield over a given solid angle of interest.

Figure 4A:
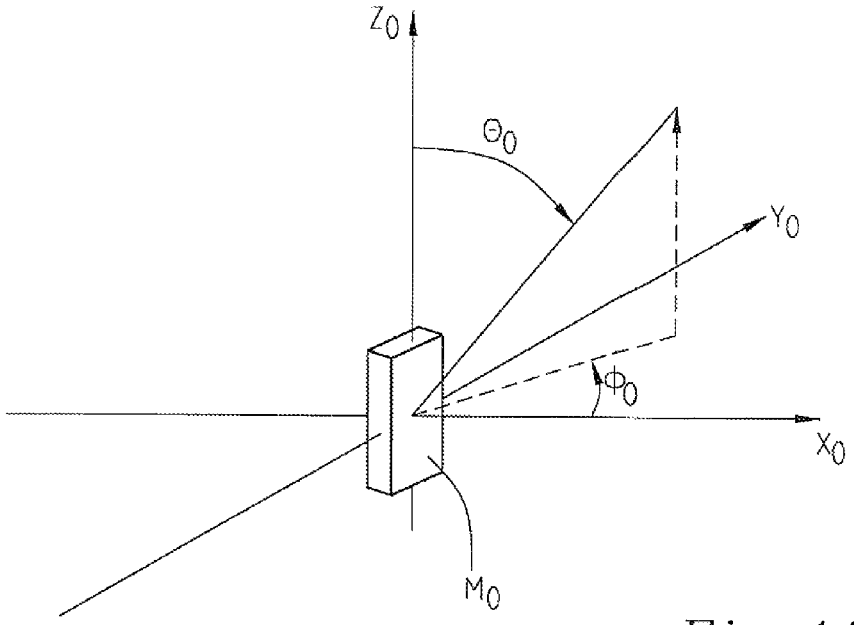
FIG. 4A shows a coordinate system which is fixed with respect to an antenna means.
Figure 4B:
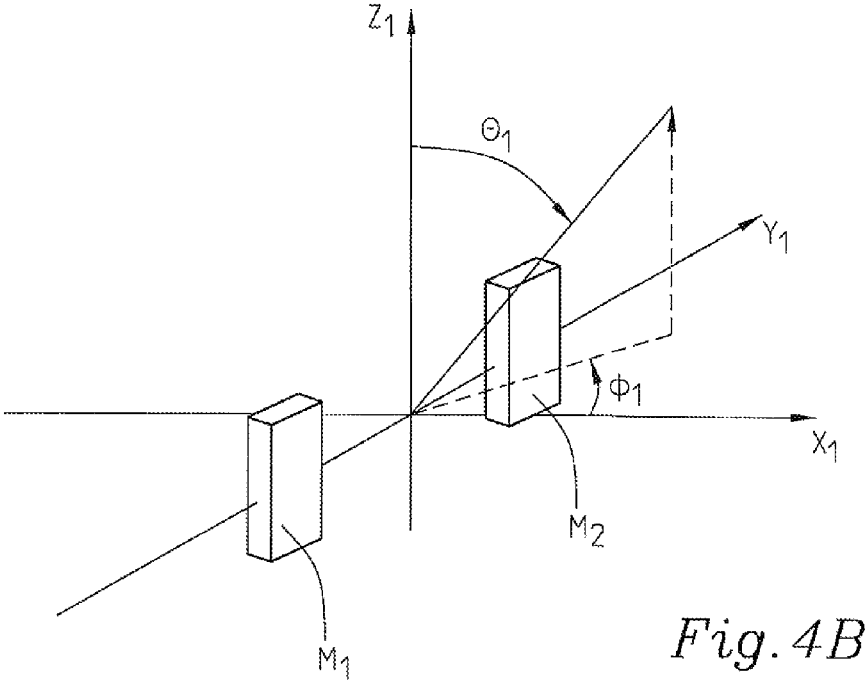
FIG. 4B shows a coordinate system which is fixed with respect to an antenna arrangement.

The polarization controlling means comprises at least a main forming network (not indicated in this figure) which is a network in which ports associated with non-parallel polarizations are connected. The polarizations are defined in a coordinate system which is common for both antenna means, also called an antenna arrangement based coordinate system $x_1$, $y_1$, $z_1$, cf. FIG. 4B showing two antenna means $M_1$, $M_2$ in the common antenna arrangement coordinate system, wherein $\Phi_1$ indicates the azimuth angle and $\theta_1$ indicates the elevation angle. For an antenna arrangement the positions and rotations of the individual antenna means $M_1$, $M_2$ are given in this common antenna arrangement based coordinate system which is different from an antenna means based coordinate system $x_0$, $y_0$, $z_0$, which is fixed with respect to a specific antenna means $M_0$ as illustrated in FIG. 4A wherein $\Phi_0$ indicates the azimuth angle and $\theta_0$ indicates the elevation angle. Through appropriately arranging or configuring the polarization controlling means, and appropriate selection of control parameters, beams having desired polarization properties are obtained at external interface antenna arrangement ports $\mathbf{30}_1$, $\mathbf{30}_2$, $\mathbf{30}_3$, $\mathbf{30}_4$. The antenna part is here any conventional antenna, an antenna for which the polarization is essentially invariant, i.e., does not vary, with the direction.

Figure 5:
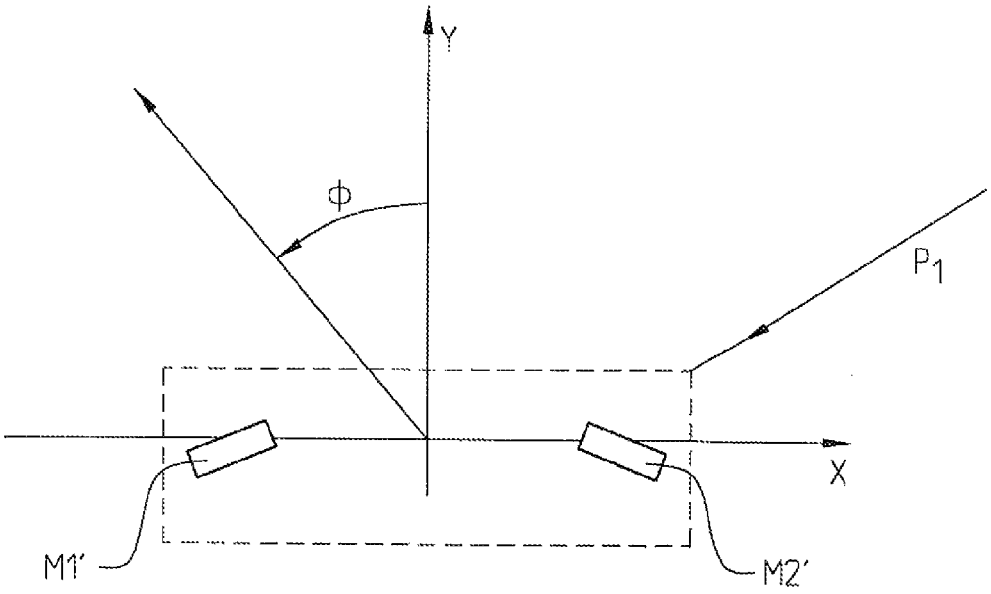
FIG. 5 shows an antenna arrangement with two antenna means having different amplitude characteristics in the coordinate system fixed with respect to the antenna arrangement.

FIG. 5 shows two antenna means M1', M2' having different amplitude characteristics in the antenna arrangement coordinate system. The two antenna means M1', M2' are here assumed to have identical amplitude characteristics in the antenna means based coordinate system. The different amplitude characteristics in the antenna arrangement based coordinate system are implemented or provided by rotations of the antenna means around the z-axis (top view).

Figure 6A:
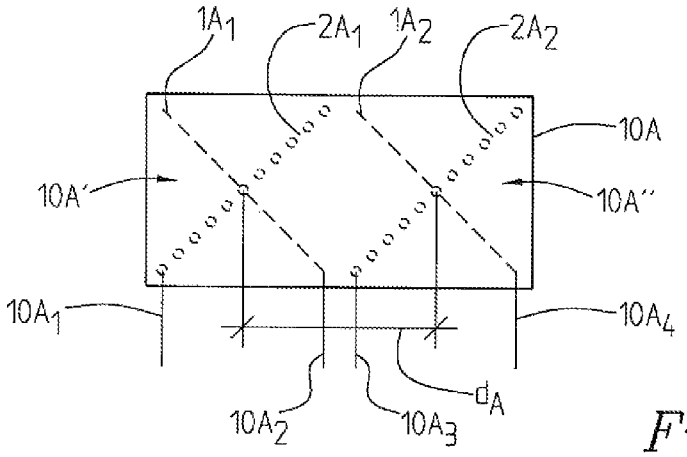
FIG. 6A shows a first implementation of an antenna part that can be used in an antenna arrangement according to the present invention.

FIG. 6A shows a first implementation of an antenna part 10A that can be used in an antenna arrangement according to the present invention, for example as described in FIG. 3, but also in any other antenna arrangement covered by the inventive concept.

The antenna part 10A here comprises one physical unit with first antenna means 10A' and second antenna means 10A". Each antenna means 10A', 10A" comprises a respective first antenna element $\mathbf{1}A_1$, $\mathbf{1}A_2$ with a first polarization (dashed line) and a respective second antenna element $\mathbf{2}A_1$, $\mathbf{2}A_2$ with a second polarization (dotted line) which is different from said first polarization.

The antenna part 10A here is a dual polarized array antenna comprising one physical unit and it has two antenna part ports $\mathbf{10}A_1$, $\mathbf{10}A_2$, $\mathbf{10}A_3$, $\mathbf{10}A_4$ per polarization. Antenna part ports $\mathbf{10}A_1$, $\mathbf{10}A_2$ are the antenna ports of the first antenna means 10A'. The polarizations for antenna elements $\mathbf{1}A_1$, $\mathbf{2}A_1$ are essentially orthogonal to one another and the location of phase centers for antenna elements associated with antenna part ports $\mathbf{10}A_1$, $\mathbf{10}A_2$ is substantially the same. The situation is similar for the second antenna means 10A" with an antenna part port $\mathbf{10}A_4$ for the respective first antenna element $\mathbf{1}A_2$ of the first polarization and an antenna part port $\mathbf{10}A_3$ for the second antenna element $\mathbf{2}A_2$ with the second polarization. The polarization is parallel within pairs of radiation patterns associated with antenna part ports $\mathbf{10}A_1$, $\mathbf{10}A_3$ and $\mathbf{10}A_2$, $\mathbf{10}A_4$ respectively, and orthogonal for the antenna part ports of one and the same antenna means. The phase centers for antenna means 10A', 10A" are spatially separated a distance $d_A$, see definition of phase center distance given above.

Figure 6B:
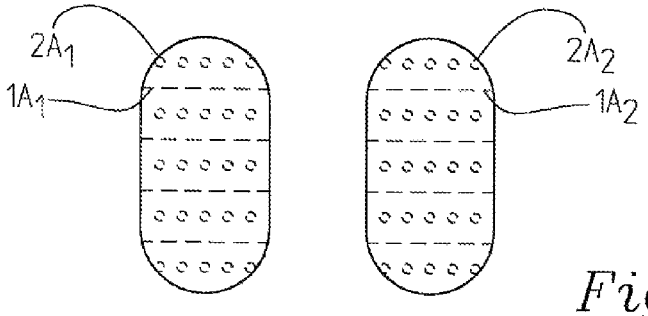
FIG. 6B illustrates beam direction and polarization for the antenna part in FIG. 6A.

FIG. 6B schematically indicates the beam directions and first and second polarizations for the antenna means of FIG. 6A. The beam directions of the antenna means are substantially identical and thus have the same pointing direction in a global coordinate system, cf. an antenna arrangement coordinate system as discussed above with reference to FIG. 4A.

Figure 7A:
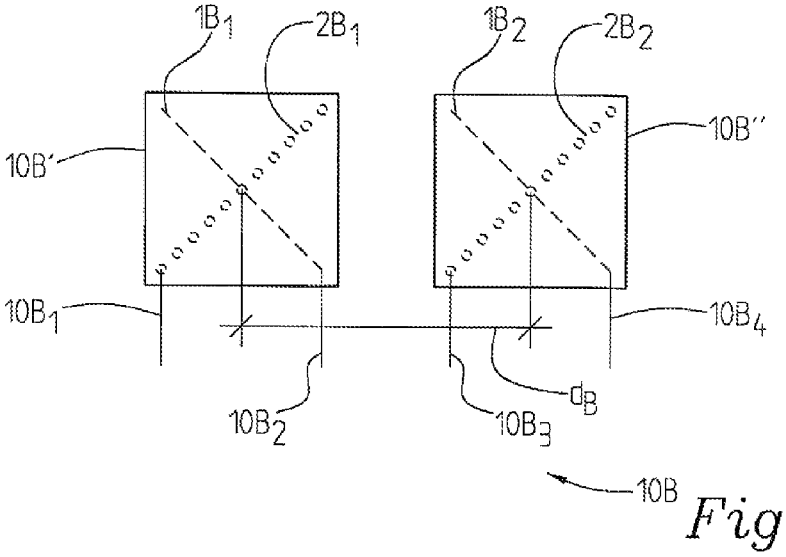
FIG. 7A shows a second implementation of an antenna part that can be used in an antenna arrangement according to the present invention.

FIG. 7A schematically illustrates a second implementation of an antenna part 10B that can be used in an antenna arrangement according to the present invention. The antenna part 10B comprises two physical units 10B', 10B", each forming a functional unit antenna means. Each antenna means 10B', 10B" comprises a number of first antenna elements $\mathbf{1}B_1$ and $\mathbf{1}B_2$ and a number of second antenna elements $\mathbf{2}B_1$, $\mathbf{2}B_2$. The polarizations for the signals transmitted via the first and the second antenna elements are basically orthogonal. The phase centers for antenna means 10B', 10B" are arranged or separated spatially a distance $d_B$, see definition above. For each antenna means 10B', 10B" there are two antenna part ports $\mathbf{10}B_1$, $\mathbf{10}B_2$ and $\mathbf{10}B_3$, $\mathbf{10}B_4$ one for each polarization and each antenna element as discussed above. For the two antenna means 10B', 10B" the amplitude and phase characteristics of the radiation pattern are identical for all antenna part ports $\mathbf{10}B_1$, $\mathbf{10}B_2$, $\mathbf{10}B_3$, $\mathbf{10}B_4$ from an angular point of view, which means that the first and second antenna means 10D', 10D" have the same pointing direction in a global coordinate system, cf. an antenna arrangement based coordinate system, as in FIG. 4B. The polarization of the radiation pattern is essentially independent of spatial angle within the main beam.

Figure 7B:
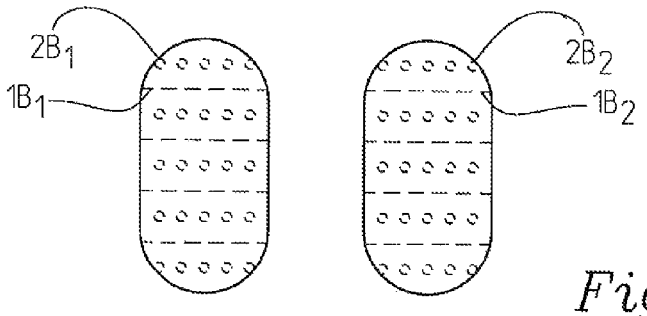
FIG. 7B illustrates beam direction and polarization for the antenna part in FIG. 7A.

FIG. 7B indicates beam directions and polarizations for the antenna elements of the respective antenna means of FIG. 7A, in a manner similar to that described with reference to FIG. 6B.

Figure 8A:
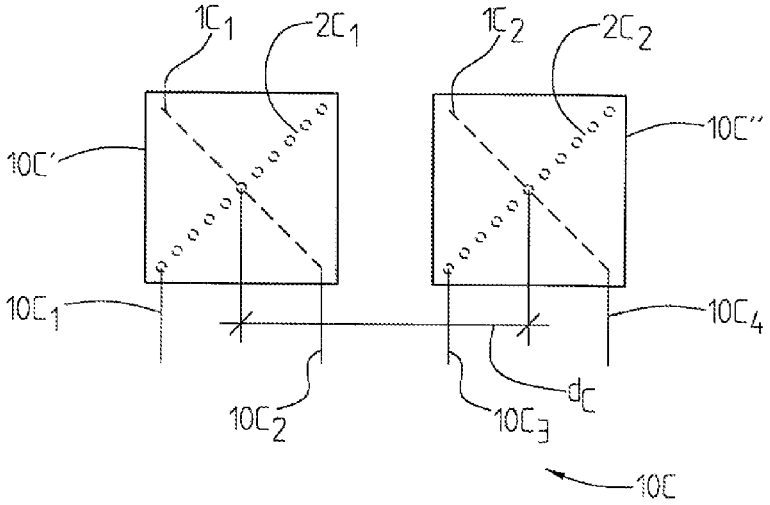
FIG. 8A shows a third implementation of an antenna part that can be used in an antenna arrangement according to the present invention.

FIG. 8A illustrates a third embodiment of an antenna part 10C which can be used in an antenna arrangement according to the present invention. The antenna part 10C comprises first antenna means 10C' and second antenna means 10C" which are implemented as separate physical units arranged at a spatial distance $d_c$ from each other. The first antenna means 10C' comprises a number of first antenna elements (only one shown) $\mathbf{1}C_1$ with a first polarization and a number of second antenna elements $\mathbf{2}C_1$, only one shown, with a second polarization different from said first polarization. The antenna part 10C is similar to that of FIG. 7A (10B) but with the difference that, although the radiation pattern amplitude and phase characteristics are identical for all antenna ports $\mathbf{10}C_1$, $\mathbf{10}C_2$, $\mathbf{10}C_3$, $\mathbf{10}C_4$ in an angular respect, in an antenna means coordinate system, cf. FIG. 4A, they are not identical with respect to a global or antenna arrangement based coordinate system, cf. FIG. 4B. This means that the antenna means are identical, but have different pointing directions in the antenna arrangement based coordinate system. This is explicitly illustrated in FIG. 8B which shows two lobes with the first and second polarization, $\mathbf{1}C_1$, $\mathbf{1}C_2$ and two lobes in another direction with the first and the second polarization $\mathbf{1}C_1$, $\mathbf{2}C_2$ respectively. The first and second antenna means 10C', 10C" have different spatial amplitude distributions, which means that in the common coordinate system they have different distributions. The radiation pattern polarization does not change with angle within the main beam for a given antenna part port, as in the preceding embodiments of antenna parts. For a first set of pairs of antenna part ports the polarization is parallel within the respective pairs (10$C_1$, 10$C_3$ and 10$C_2$, 10$C_4$ respectively) and orthogonal between pairs (10$C_1$ and 10$C_2$ are orthogonal and 10$C_3$ and 10$C_4$ are orthogonal) also as in the preceding embodiments. For a second set of pairs of antenna part ports, each pair associated with one physical antenna unit (antenna means 10C', 10C"), the spatial locations of phase centers are identical and the polarization orthogonal within pairs of antenna part ports and the spatial locations of phase centers are different between pairs. In principle any kind of physical configuration of the antenna part can be used as long as the characteristics associated with the antenna part are such as described above. The embodiments described above only show some examples.

Figure 8B:
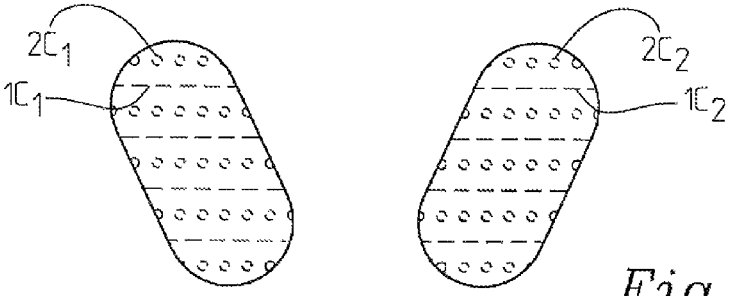
FIG. 8B illustrates beam direction and polarization for antenna means of the antenna in FIG. 8A.
Figure 9:
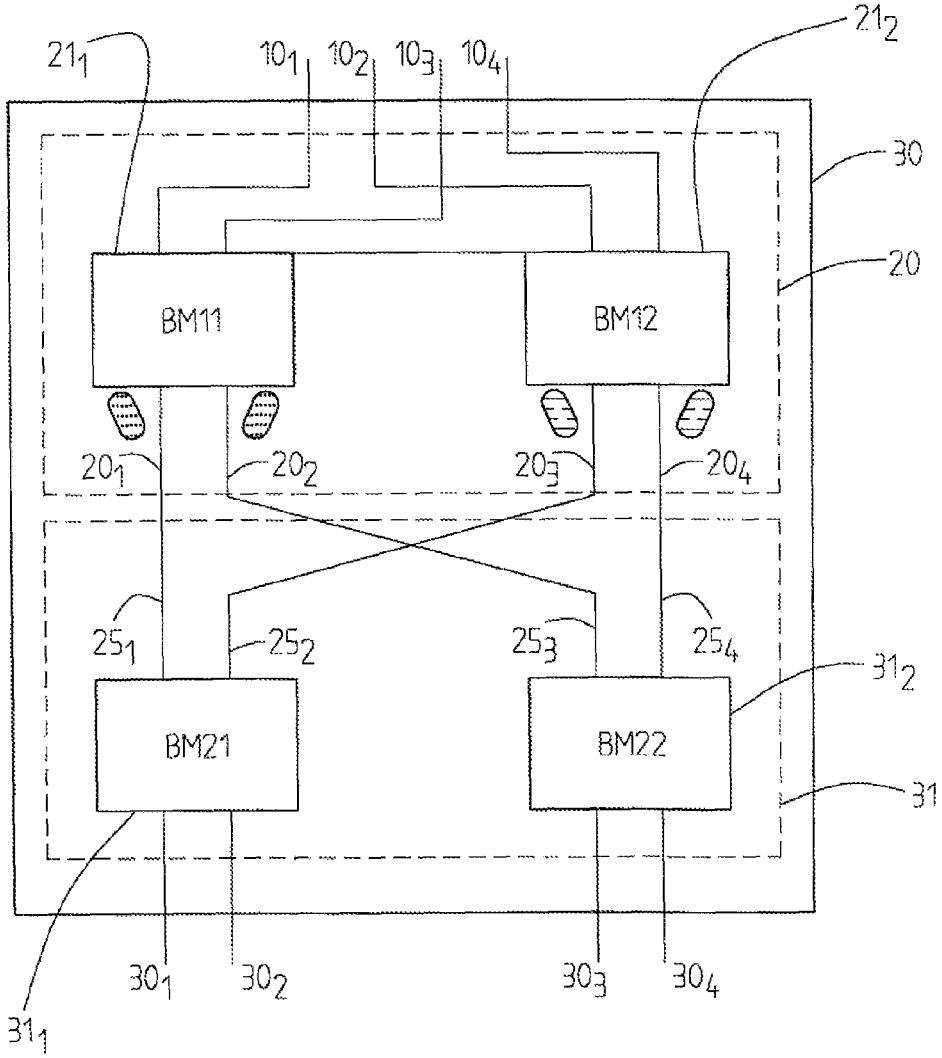
FIG. 9 shows an implementation of polarization controlling means that can be used in an antenna arrangement according to the present invention.

FIG. 9 shows a first implementation of a polarization controlling means 30 that can be used for example with any one, except FIGS. 8A and 8B, of the antenna parts described above. The polarization controlling means 30, which consists of a distribution network, here particularly a main forming network 31 thereof, has four external interface antenna ports 30$_1$, 30$_2$, 30$_3$, 30$_4$. They may also be called novel or modified antenna part ports. In an alternative embodiment, cf. FIG. 11, the polarization controlling means has two external interface antenna ports. In still other embodiments, not shown, it could have other numbers of external interface antenna ports as well.

As referred to above, through the polarization controlling means an antenna arrangement is provided for which the polarizations of the radiation patterns are configured to change with angle within the main lobe. The variation in polarization with angle associated with the external interface antenna ports is created by means of, in the polarization controlling means, combining signals from multiple antenna part ports, in FIG. 9 antenna part ports 10$_1$, 10$_2$, 10$_3$, 10$_4$, which for example have characteristics similar to those of conventional antennas and as discussed above. Generally the polarization forming means 30 is configured to combine antenna part ports such that antenna part ports with different polarizations and which are spatially separated, have different phase center positions, are combined.

The polarization controlling means 30 is mathematically described by a matrix. According to different embodiments the matrix comprises a four-by-four or a four-by-two matrix. Alternatively, as in FIG. 9, the polarization controlling means comprises four two-by-two matrices.

For a sector antenna system consisting of several antenna arrangements according to any one of the embodiments, a general object is that polarization parallelity for the radiation patterns in the direction defined by opposite sector borders shall be approximately zero for all external interface antenna ports, and that polarization parallelity, in directions as defined by opposite sector borders, for radiation patterns associated with any two external interface antenna ports shall be sufficiently low.

In FIG. 9 the antenna part is supposed to be as described in FIG. 6A, 6B or 7A, 7B, which means that the radiation patterns associated with all antenna part ports 10$_1$, 10$_2$, 10$_3$, 10$_4$ have the same characteristics with respective to amplitude and phase. The polarization controlling means 30 is here so configured that all antenna part ports 10$_1$, 10$_2$, 10$_3$, 10$_4$ are connected to all external interface antenna ports 30$_1$, 30$_2$, 30$_3$ and 30$_4$. The polarization forming means 30 comprises a main forming network 31 comprising a first 2×2 Butler matrix BM21 31$_1$ and a 2×2 second Butler matrix BM22 31$_2$. Alternatively some other kind of distribution network could be used. The polarization controlling means 30 in this embodiment also comprises a pre-forming network 20 comprising a first 2×2 Butler matrix BM11 21$_1$ and a second 2×2 Butler matrix BM12 21$_2$ In the pre-forming network 20 signals originating from or destinated to antenna ports 20$_1$, 20$_3$ and 20$_2$, 20$_4$ respectively with identical polarization but different phase centers (different antenna means) are connected to form orthogonal beams per polarization, i.e. in BM11 21$_1$ antenna part ports 10$_1$ and 10$_3$ are combined, whereas in BM12 21$_2$ the antenna part ports 10$_2$ and 10$_4$ are combined. The pointing directions of beams within a first set of beams corresponding to a first polarization do not necessarily have to coincide with the pointing directions of the beams of the second set of beams corresponding to a second polarization even if the beams have coinciding directions in FIG. 9. The pre-forming network has pre-forming network intermediate ports 20$_1$, 20$_2$, 20$_3$, 20$_4$ the beams in the figure indicating pointing directions of the respective beams and polarizations.

The Butler matrices can be described as:

$$BM = \frac{1}{\sqrt{2}}\begin{bmatrix} 1e^{j\delta/2} & je^{j-\delta/2} \\ je^{j\delta/2} & 1e^{-j\delta/2} \end{bmatrix}$$

wherein for each Butler matrix δ actually should read $\delta_{nn}$, wherein nn is the matrix identification number. The slope of the phase fronts is given by $\delta_{nn}$. In the main forming network 31 comprising Butler matrices BM21 and B22, pre-forming network interface ports 20$_1$, 20$_2$, 20$_3$, 20$_4$ are connected to main forming network interface ports 25$_1$, 25$_2$, 25$_3$, 25$_4$, to form modified or controlled beams at the external interface antenna ports 30$_1$. 30$_2$, 30$_3$, 30$_4$; one of each Butler matrix above in each combination. The parameters $\delta_{nn}$ of the respective matrices affect the resulting polarization and constitute one control means (parameters) used for generation of desired polarization characteristics for the beams obtained at the external interface antenna ports. As an example, parameter $\delta_{12}$ can be set identical to $\delta_{11}$, and $\delta_{22}$ can be set identical to $\delta_{21}$. The parallelity between polarizations for any antenna port at opposite sector borders depends only on the phase center separation for $\delta_{11}=\delta_{12}$ and $\delta_{21}=\delta_{22}$. As an example a phase center separation is such that orthogonal polarization (subtended angle=180°) is achieved at opposite cell borders for each four antenna ports. This is obtained for phase center distance dr=0.87 (distance given in wavelengths).

One example for setting parameters $\delta_{11}$ and $\delta_{21}$ is to give maximum subtended angle for any of the four external interface antenna ports to all four external interface antenna ports at the opposite cell borders. This means that the polarization for the antenna ports at a sector border have maximum separation on a Poincaré sphere which corresponds to a subtended angle of 109.5°.

This is achieved for $\delta_{11}=55°$ and $\delta_{21}=45°$.

Another example is, for parameter $\delta_{12}$ set identical to $\delta_{11}$ and $\delta_{22}$ set identical to $\delta_{21}$, to set parameters dr, $\delta_{11}$ and $\delta_{21}$ such that the lowest gain from vector combination of a signal transmitted from two antennas is maximized. This is achieved for:

dr=1.05

$\delta_{11}=50°$ $\delta_{21}=47°$

Figure 10:
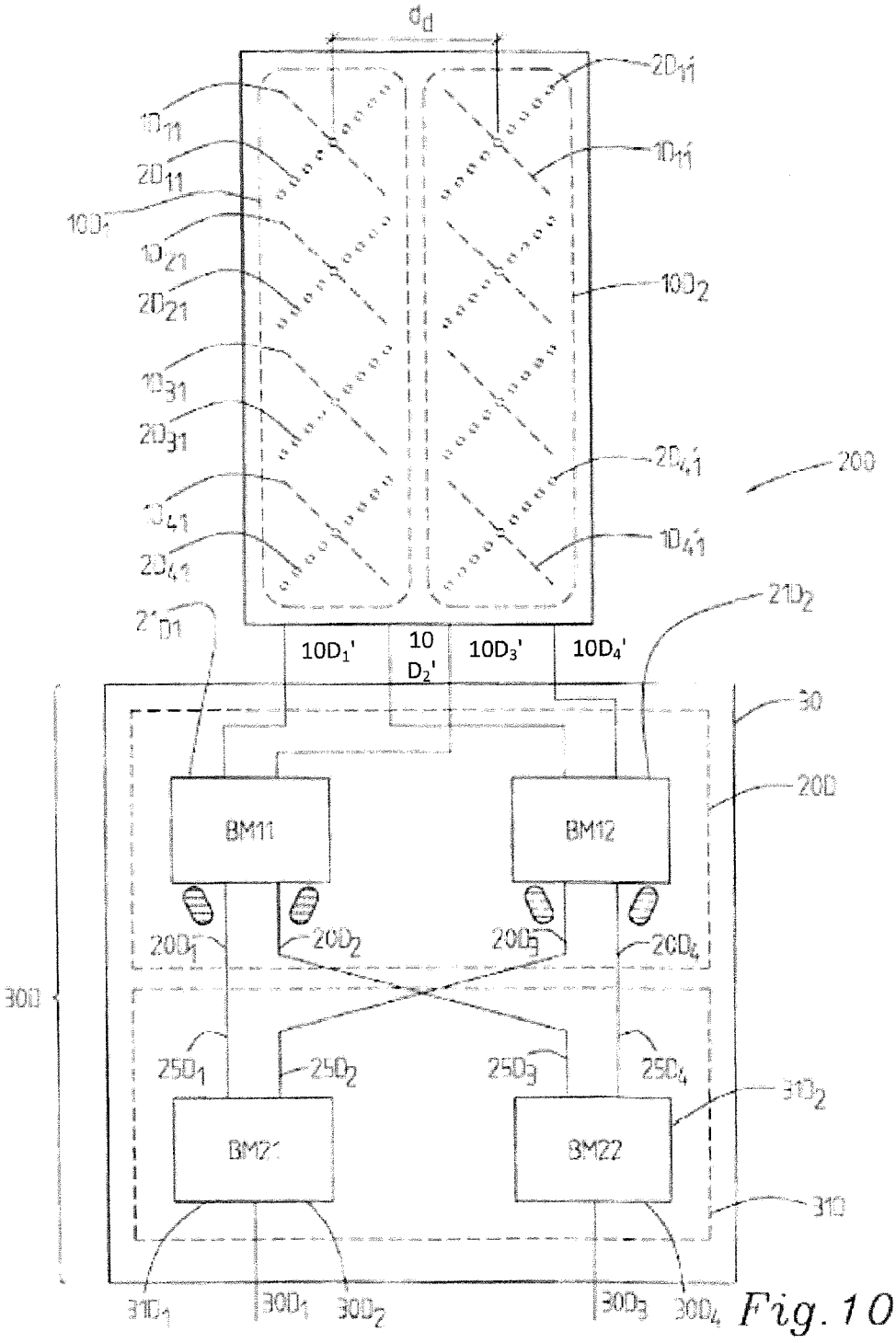
FIG. 10 shows an embodiment of an antenna arrangement comprising polarization controlling means as in FIG. 6 and FIG. 7.

FIG. 10 shows an antenna arrangement 200 comprising an antenna part 10D and polarization controlling means 30D. The antenna part 10D comprises first and second antenna means 10D1 and 10D2. The first antenna means 10D1 comprises four first antenna elements $1D_{11}$, $1D_{21}$, $1D_{31}$, $1D_{41}$ having a first polarization and four second antenna elements $2D_{11}$, $2D_{21}$, $2D_{31}$, $2D_{41}$ which are co-located with respective ones of said first antenna elements and have a polarization which is orthogonal to, or at least not parallel with the polarization of said first antenna elements. Similarly the second antenna means 10D2 comprises four first antenna elements $1D'_{11}, \ldots, 1D'_{41}$, with the same polarization and corresponding to the first antenna elements of the first antenna means, and they are also co-located with second antenna elements $2D'_{11}, \ldots, 2D'_{41}$ with the same polarization as said second antenna elements of the first antenna means. The respective antenna means (column arrays) are arranged at a phase center distance $d_d$ from each other as in the preceding embodiments.

The antenna part 10D comprises four antenna part ports $10D_1'$, $10D_2'$, $10D_3'$, $10D_4'$, one for each polarization and each antenna means respectively. The beam polarization controlling means 30D comprises a pre-forming network 20D and a main forming network 31D. In a first 2×2 Butler matrix $21D_1$ antenna part ports $10D_1'$ and $10D_3'$ for antenna elements having the same polarization but being located in different antenna means are connected. Similarly in a second Butler matrix $21D_2$ antenna part ports $10D_2'$ and $10D_4'$ having the second polarization of different antenna means are connected. Pre-forming network intermediate ports are connected to main forming network intermediate ports such that ports with the same polarization but different orientation are combined in different Butler matrices. In first Butler matrix $31D_1$ of the main forming network pre-forming network intermediate ports $20D_1$, $20D_4$ are combined and in second Butler matrix $31D_2$ of the main forming network pre-forming network intermediate ports $20D_2$, $20D_3$ are combined. In the first and second Butler matrices $31D_1$, $31D_2$ the respective signals are combined using appropriately selected control parameters $\delta_{nm}$ in the respective Butler matrix as discussed above to provide beams at external interface antenna ports $30D_1$, $30D_2$, $30D_3$, $30D_4$ having selected, desired polarization properties. Thus, in the respective Butler matrices, in the pre-forming network as well as in the main forming network, respective control parameters are individually selected to give desired polarization properties, i.e. varying polarization with spatial angle. All control parameters may be given the same value, all may be given different values, or two or three of them may be given the same value.

Figure 11:
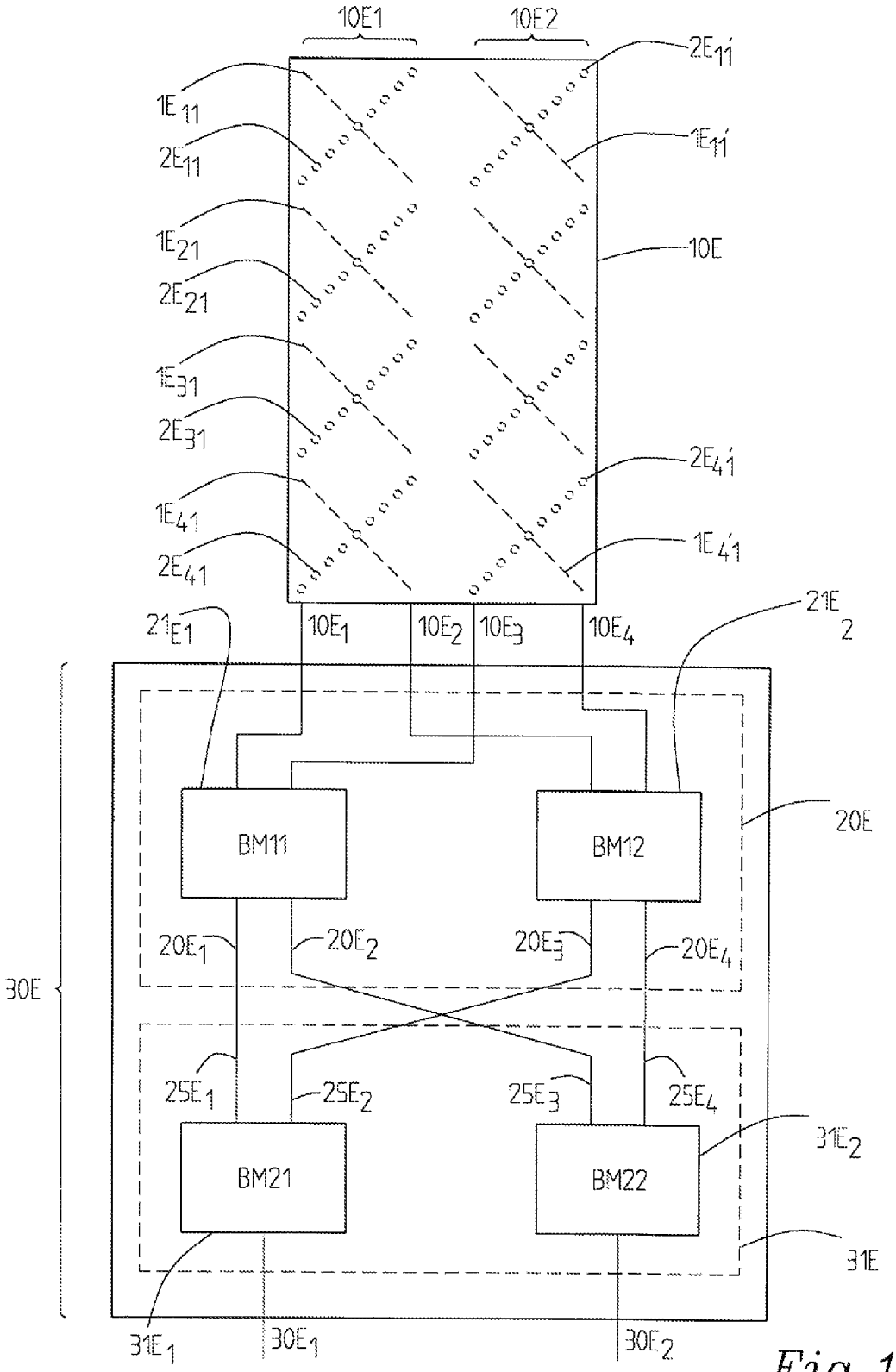
FIG. 11 shows an alternative embodiment of an antenna arrangement comprising an antenna part as in FIG. 10 with alternative polarization controlling means.

FIG. 11 shows an antenna arrangement 300 with an antenna part as disclosed in FIG. 10, i.e. an antenna part 10E comprising two antenna means 10E1, 10E2 each with a number of first antenna elements $1E_{11}$, $1E_{21}$, $1E_{31}$, $1E_{41}$ and $2E'_{11}$, $2E'_{41}$ respectively having a same polarization, and a number of second antenna elements $2E_{11}, \ldots, 2E_{41}$ and $2E'_{11}, \ldots, 2E'_{41}$ respectively with a second polarization different from said first polarization. It comprises four antenna part ports $10E_1$, $10E_2$, $10E_3$, $10E_4$ connected to a pre-forming network 20E in such a manner that ports $10E_1$ and $10E_3$ of the first and second antenna means are connected, i.e. antenna elements having the same parallel polarizations are combined in first Butler matrix $21E_1$, and the ports $10E_2$ and $10E_4$ for the second antenna elements having the second polarization are combined in second Butler matrix $21E_2$. Pre-forming network intermediate ports $20E_1$, $20E_2$, $20E_3$, $20E_4$ are combined in a main forming network 31E such that ports $20E_1$ and $20E_4$ are combined in a first Butler matrix $31E_1$ whereas ports $20E_2$ and $20E_3$ are combined in second Butler matrix $31E_2$. The difference is that in this case there are only two external interface antenna ports $30E_1$, $30E_2$ at which beams are provided having polarization properties given by selected control parameters of the respective Butler matrices.

Figure 12:
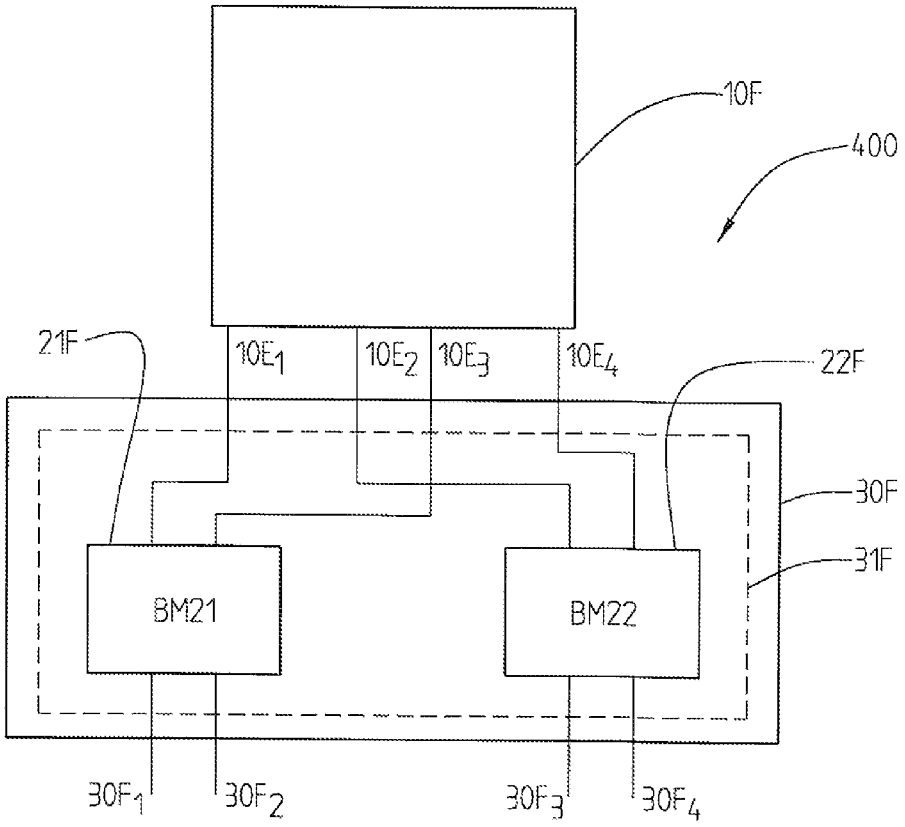
FIG. 12 shows still another embodiment of an antenna arrangement with polarization controlling means.

FIG. 12 shows still another example of an antenna arrangement 400 comprising an antenna part 10F which for example may be of the kind disclosed in FIGS. 8A, 8B. This means that the radiation patterns associated with antenna part ports $10F_1$ and $10F_2$ have different characteristics with respect to amplitude and phase in an antenna arrangement coordinate system compared to ports $10F_3$ and $10F_4$. The antenna means have different pointing directions in a global, antenna arrangement based coordinate system. In this case it is supposed that there is no pre-forming network but only a main forming network 31F with two Butler matrices BM21F and BM22F. In BM21F antenna part ports $10F_1$ and $10F_4$ are connected whereas in BM22F ports $10F_2$ and $10F_3$ are connected and, as referred to above, the radiated electromagnetic field associated with ports have different characteristics with respect amplitude and phase but they do not have to be orthogonal, although they could be. The main forming network has four external interface antenna ports, $30F_1$, $30F_2$ of BM21F and $30F_3$, $30F_4$ of BM22F. In the respective Butler matrices are hence ports connected associated with beams which have orthogonal polarization and non-identical spatial location. As referred to above, each Butler matrix has control parameters $\delta_{nm}$ which determine the resulting polarization and hence the resulting polarization characteristics at the external interface antenna ports.

An example of setting the parameter $\delta_{21}$ is to set it to give maximum subtended angle for any of the four antenna ports to all four antenna ports at the opposite cell border. This means the polarization for the antenna ports at a sector border have maximum separation on a Poincaré sphere given the freedom in the current implementation giving that all polarization lies on a great circle.

In an alternative embodiment which also can be described with reference to FIG. 12, the antenna part is as described with reference to FIG. 6A, 6B or 7A, 7B which means that all antenna part ports $10F_1$, $10F_2$, $10F_3$, $10F_4$ have the same characteristics with respect to amplitude and phase. As discussed above antenna part ports having orthogonal polarizations and non-identical spatial locations are combined and through appropriate selection of the control parameters the polarization characteristics can be determined.

$\delta_{11}$, $\delta_{12}$ do not exist, since there is no pre-forming network. $\delta_{21}$ may be set to the same value as $\delta_{22}$. In one embodiment the phase center separation is set to give orthogonal polarization (subtended angle=180° at opposite cell borders within all four antenna part ports, e.g. =0.87λ (wavelength).

It should be clear that also in these embodiments there could have been two external interface antenna ports, any variation in principle being possible. It should also be clear that the distribution network forming the polarization controlling means may consist of Butler matrices with other dimensions etc. Any values of control parameters, phase center distance are merely given for exemplifying reasons.

Figure 13:
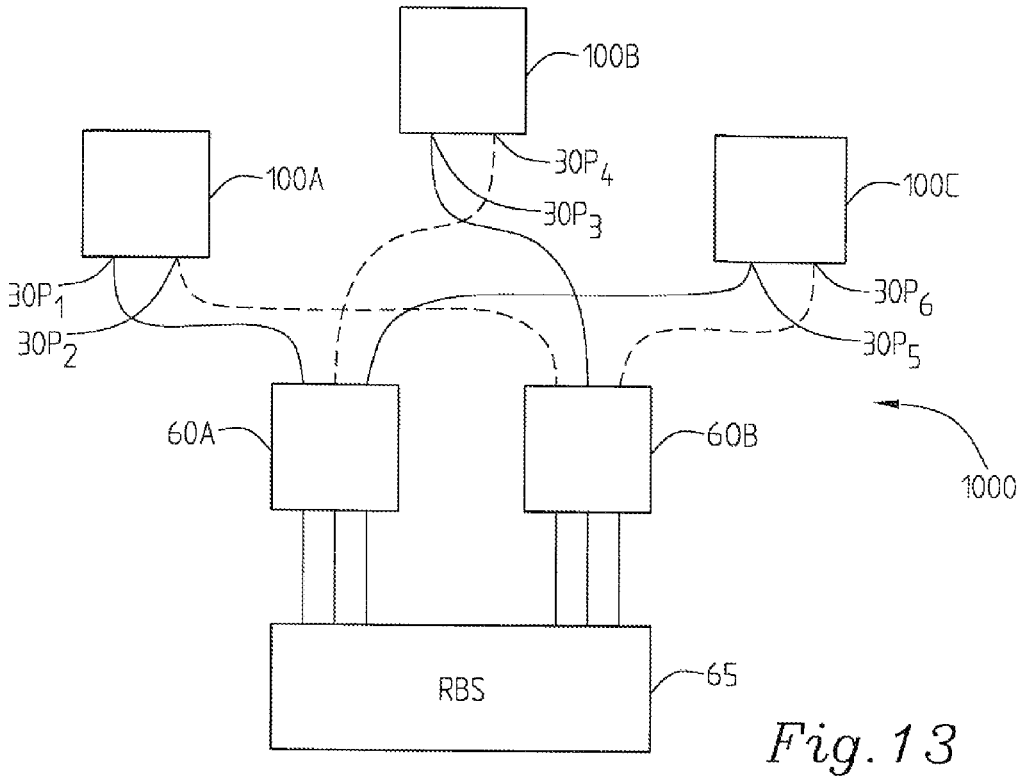
FIG. 13 shows an embodiment of an antenna system with antenna arrangements according to the invention, the antennas being connected to a configuration network in a first manner.

FIG. 13 schematically illustrates an antenna system comprising three antenna arrangements 100A, 100B, 100B, one for each sector at a three sector site, allowing the configuration of the number of sectors via combination of antenna arrangements corresponding to two or more adjacent sectors in a configuration network, here illustrated as two configuration network means 60A, 60B. In FIG. 13 there are for reasons of simplicity only illustrated two external interface antenna ports $30P_1$, $30P_2$; $30P_3$, $30P_4$; $30P_5$, $30P_6$ per antenna arrangement. There may of course be more ports per sector. Through the inventive implementation of antenna arrangements, antenna part ports corresponding to adjacent sectors can be connected without having coherent addition of signals along sector borders, which may be destructive.

Figure 14:
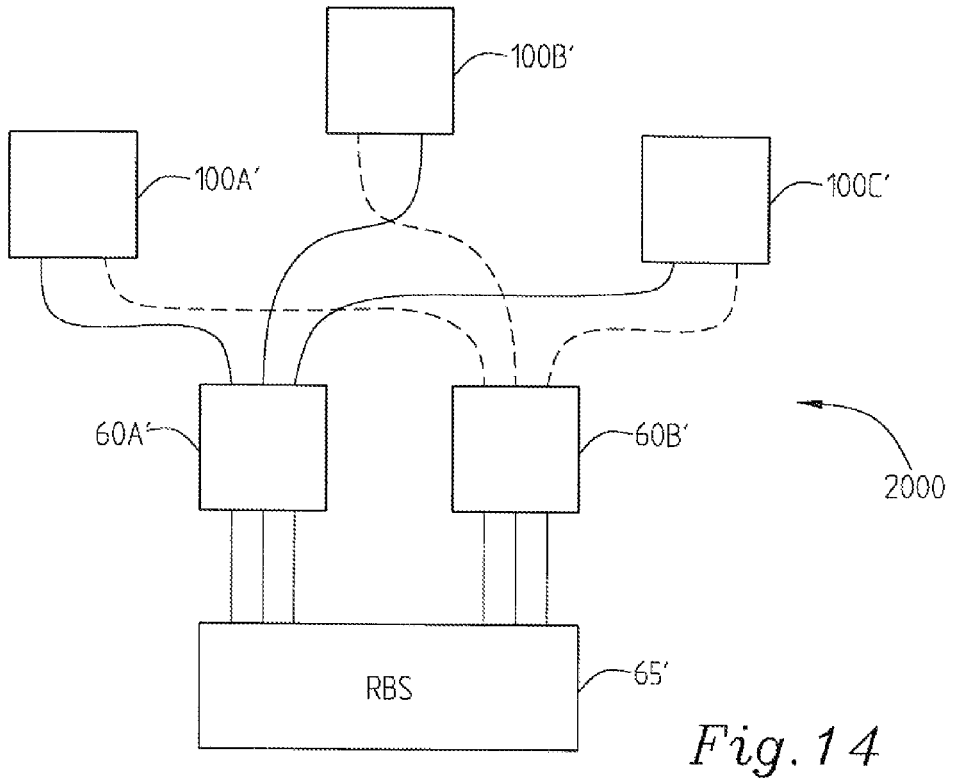
FIG. 14 shows an antenna system with antennas connected to a configuration network in a second manner.

In FIGS. 13, 14 full lines indicate connection of antenna part ports of a first polarization to the configuration network 60A, 60B, 60A', 60B' and dashed lines relate to ports of another polarization connecting to the configuration network 60A, 60B; 60A', 60B'. In FIG. 13 ports of different polarizations are connected in a first configuration network means 60A, whereas the three ports also of different polarization are connected in second configuration network means 60B.

In FIG. 14 two ports of each of three antenna arrangements 100A', 100B', 100C' of a system 2000 are connected to configuration network means 60A', 60B'. As in FIG. 13 full lines relate to a first polarization, whereas dashed lines relate to a second polarization. In FIG. 14 antenna arrangement ports of the same polarization are connected in the respective configuration network means 60A', 60B'.

Figure 15A:
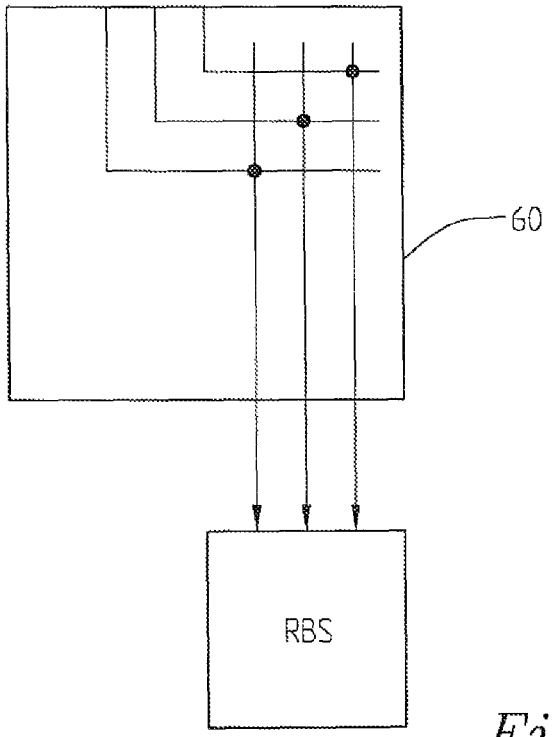
FIG. 15A shows connections in the configuration networks of FIG. 13, FIG. 14 for a three sector configuration.
Figure 15B:
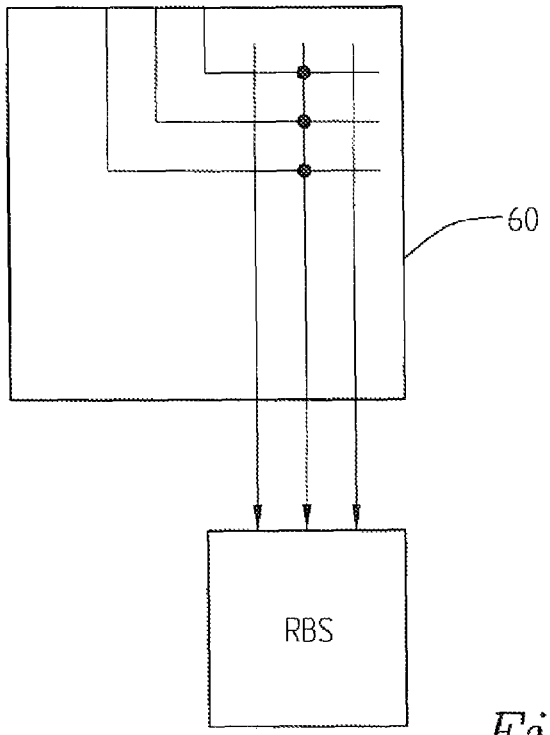
FIG. 15B shows connections as in FIG. 15A for an omnidirectional configuration.

FIG. 15A shows how the connection is done in the respective configuration network means 60 (i.e. 60A, 60B, 60C, 60A', 60B' 60C') for a three sector configuration, whereas FIG. 15B shows the connection for an omni-directional configuration. For the three sector configuration all signals are connected to the RBS (Radio Base Station) 65; 65', whereas for the omni-directional configuration there is a signal only on one cable.

It thus becomes possible to perform a reconfiguration from a three sector site during high traffic hours to a single sector-side, an omni-directional site, during low traffic hours without the impact of incorrect cabling of antenna part ports within a sector or incorrect combination of cables from different sectors being as serious as in known arrangements, actually only having a very limited impact. The reconfiguration can be done by means of switches (not explicitly shown) in the configuration network means 60A, 60B; 60A', 60B'.

According to the invention an antenna arrangement is provided through which the polarization properties associated to an antenna can be controlled to vary in a desired manner with azimuth and/or elevation angles. The way the polarization is varied, depends on what properties the beams of the antenna arrangement (antenna system) should have.

It should be clear that the invention can be varied in a number of ways without departing from the scope of the appended claims and the invention is by no means limited to the particularly illustrated embodiments.

The invention claimed is:

1. An antenna arrangement comprising:

an antenna part comprising a first antenna and a second antenna, wherein the first antenna is a column array that includes a first plurality of antenna elements having a first polarization and a second plurality of antenna elements having a second polarization different from said first polarization and wherein the second antenna is a column array that includes a third plurality of antenna elements having the first polarization and a fourth plurality of antenna elements having the second polarization, and wherein the first plurality of antenna elements and the second plurality of antenna elements are centered along a first axis, and the third plurality of antenna elements and the fourth plurality of antenna elements are centered along a second axis offset from the first axis, the antenna arrangement further comprising:

four antenna part ports in communication with the first plurality of antenna elements, the second plurality of antenna elements, the third plurality of antenna elements, and the fourth plurality of antenna elements, respectively;

a polarization controller that comprises a distribution network connected to the four antenna part ports, wherein the distribution network includes at least a main forming network having external interface antenna ports and pre-forming network that is connected to the four antenna part ports and to the main forming network, wherein the pre-forming network includes intermediate ports and a first sub-network and a second sub-network, wherein the first sub-network outputs on two of the intermediate ports a first set of intermediate signals that have the first polarization and different beam orientations among themselves, and wherein the second sub-network outputs on another two of the intermediate ports a second set of intermediate signals that have the second polarization and different beam orientations among themselves, wherein the main forming network includes a third sub-network and a fourth sub-network that are connected to the intermediate ports of the pre-forming network such that intermediate signals from the pre-forming network having the same polarization are inputted to different ones of the third sub-network and the fourth sub-network, and wherein the polarization controller is configured to introduce a desired variation in polarization properties of beams associated with said external interface antenna ports.

2. The antenna arrangement according to claim 1, wherein the polarization controller is configured to introduce a variation in polarization properties with azimuth and/or elevation angle of the antenna arrangement in a coordinate system related to the antenna arrangement.

3. The antenna arrangement according to claim 1, wherein the polarization controller is configured to at least combine the first antenna elements with the second antenna elements, which have amplitude and/or phase characteristics different from those of said first antenna elements in an antenna arrangement based coordinate system, wherein the respective first antenna elements and the second antenna elements are substantially orthogonally polarized.

4. The antenna arrangement according to claim 1, wherein each of the first antenna and the second antenna comprises a dual polarized array antenna, said dual polarized array antenna being constituted by a single physical unit having at least two primary antenna ports per polarization, one for each antenna element spatial location.

5. The antenna arrangement according to claim 4, wherein the first antenna and the second antenna have different radiation characteristics with respect to spatial amplitude distribution or have different lobe directions, in a coordinate system associated with the antenna arrangement.

6. The antenna arrangement according to claim 1, wherein the first antenna and the second antenna are each a dual polarized antenna and are arranged at a given spatial distance from each other, and each comprising a number of antenna elements, and each comprising two antenna part ports, one per polarization.

7. The antenna arrangement according to claim 6, wherein the first antenna and the second antenna have different radiation characteristics with respect to spatial amplitude distribution, or have different lobe directions, in a coordinate system associated with the antenna arrangement.

8. The antenna arrangement according to claim 1, wherein the polarization controller is configured to combine antenna part ports of antenna elements having different spatial location and different spatial phase distribution and/or different spatial amplitude distribution characteristics.

9. The antenna arrangement according to claim 1, wherein the first sub-network, second sub-network, third sub-network, and fourth sub-network of the polarization controller comprise at least one Butler matrix with at least one control parameter (δij) selected to determine the polarization associated to external interface antenna ports.

10. The antenna arrangement according to claim 9, wherein the polarization controller comprises at least one 4×4 or 4×2 Butler matrix or two or more 2×2 Butler matrices and in that selected control parameters thereof (δij) are adapted to provide desired polarization properties in selected directions for radiation patterns associated to one or more of the external interface antenna ports.

11. The antenna arrangement according to claim 1, wherein the first antenna and the second antenna have a linear polarization, the first antenna elements having a +45' or −45° polarization and the second antenna elements having a −45° or +45° polarization respectively.

12. The antenna arrangement according to claim 1, wherein the first antenna elements have linear vertical polarization and the second antenna elements have linear horizontal polarization or vice versa.

13. The antenna arrangement according to claim 1, wherein the first antenna elements are left-hand circular polarized or right-hand circular polarized and that the second antenna elements are right-hand circular polarized or left-hand circular polarized.

14. The antenna arrangement according to claim 1, wherein the first and second antenna elements have non-parallel elliptical polarization.

15. The antenna arrangement according to claim 1, wherein the polarization controller is configured to connect all antenna part ports with all external interface antenna ports.

16. The antenna arrangement according to claim 1, wherein the main forming network is configured to connect antenna part ports with external interface antenna ports such that at least two antenna part ports associated with radiation patterns with orthogonal polarizations and also having different characteristics with respect to amplitude and/or phase are combined.

17. The Antenna arrangement according to claim 1, wherein the number of antenna part ports is the same as or higher than the number of external interface antenna ports.

18. An antenna system comprising a number of antenna arrangements according to claim 1.

19. The antenna system according to claim 18, wherein each antenna part of an antenna arrangement is a sector antenna, wherein the antenna system comprises a configuration network for sector reconfiguration, and wherein said configuration network is adapted to allow selection of number of sectors and/or antenna parts adapted to form sectors, and thus to reconfigure sector borders.

20. An antenna system according to claim 18, wherein control parameter settings of the main forming network are selected to provide a variation in polarization orthogonality within sectors and/or at sector borders of the respective antenna arrangements.

21. A method for controlling at least one characteristic of an antenna arrangement that comprises:

an antenna part having a first antenna, a second antenna, and antenna part ports, wherein the first antenna is a column array that includes a first plurality of antenna elements having a first polarization and a second plurality of antenna elements having a second polarization different from said first polarization, wherein the second antenna is a column array that includes a third plurality of antenna elements having the first polarization and a fourth plurality of antenna elements having the second polarization, wherein the first plurality of antenna elements and the second plurality of antenna elements are centered along a first axis, and the third plurality of antenna elements and the fourth plurality of antenna elements are centered along a second axis offset from the first axis; and a polarization controller having a main forming network that includes external interface antenna ports and a pre-forming network that is connected to the antenna part ports and to the main forming network, the method comprising:

outputting, in the pre-forming network, a first set of intermediate signals on two intermediate ports and a second set of intermediate signals on another two intermediate ports, wherein the first set of intermediate signals have the first polarization and different beam orientations among themselves, and wherein the second set of intermediate signals have the second polarization and different beam orientations among themselves;

inputting the intermediate signals outputted by the pre-forming network to the main forming network, wherein the main forming network comprises two sub-networks, and wherein intermediate signals from the pre-forming network having the same polarization are inputted to different ones of the two sub-networks; and combining, in the main forming network of the polarization controller, antenna elements of the antenna part having the first polarization with antenna elements of the antenna part having the second polarization to provide beams having desired polarization properties at the external antenna ports.

22. The method according to claim 21, wherein the antenna part comprises two antenna part ports for spatially separated antenna elements having the first polarization and two antenna part ports for spatially separated antenna elements having the second polarization, each first plurality of antenna elements are co-located with the second plurality of antenna elements, said first and second plurality of antenna elements having orthogonal polarizations, and the method further comprises:

combining, in the polarization controller, all antenna part ports with all external interface antenna ports.

23. The method according to claim 21, wherein the antenna part comprises four antenna ports, including two antenna part ports for spatially separated antenna elements having the first polarization and two part antenna ports for spatially separated antenna elements having the second polarization, wherein each of the first plurality of antenna elements is co-located with one of the second plurality of antenna elements, said first and second antenna elements having orthogonal polarizations, and the method further comprises:

in a pre-combining step, combining in a pre-forming network, antenna ports of spatially separated co-polarized antenna elements to form spatially orthogonal beams per polarization at pre-forming network intermediate ports, and in a main combining step, connecting in a main forming network, a first beam of said spatially orthogonal beams with a first polarization and a second beam of said spatially orthogonal beams with a second polarization, said first and second beams being spatially orthogonal, to form beams with radiation direction dependent variation in polarization properties at external interface antenna ports.

24. The method according to claim 23, wherein the method further comprises:

performing the pre-combining step using a pre-forming, network of the distribution network comprising two first Butler matrices, with first control parameters, performing the main combining step using a main forming network comprising two second Butler matrices, with second control parameters, and selecting said first and second control parameters to give desired polarization characteristics for beams associated with the external interface antenna ports.

25. A method for providing a controllable multi-sector antenna site, comprising:

arranging a plurality of antenna arrangements as sector antenna arrangements with beams covering a number of first sectors, wherein each of the plurality of antenna arrangements comprises:

an antenna part comprising a first antenna and a second antenna, wherein the first antenna is a column array that includes a first plurality of antenna elements having a first polarization and a second plurality of antenna elements having a second polarization different from said first polarization, wherein the second antenna is a column array that includes a third plurality of antenna elements having the first polarization and a fourth plurality of antenna elements having the second polarization, wherein the first plurality of antenna elements and the second plurality of antenna elements are centered along a first axis, and the third plurality of antenna elements and the fourth plurality of antenna elements are centered along a second axis offset from the first axis;

four antenna part ports in communication with the first plurality of antenna elements, the second plurality of antenna elements, the third plurality of antenna elements, and the fourth plurality of antenna elements, respectively;

a polarization controller, comprising a distribution network connected to the four antenna ports, wherein the distribution network includes at least a main forming network having external interface antenna ports and a pre-forming network that is connected to the four antenna part ports and to the main forming network, and wherein the pre-forming network includes intermediate ports and a first sub-network and a second sub-network, wherein the first sub-network outputs on two of the intermediate ports a first set of intermediate signals that have the first polarization and different beam orientations among themselves, and wherein the second sub-network outputs on another two of the intermediate ports a second set of intermediate signals that have the second polarization and different beam orientations among themselves, wherein the main forming network includes a third sub-network and a fourth sub-network that are connected to the intermediate ports of the pre-forming network such that intermediate signals from the preforming network having the same polarization are inputted to different ones of the third sub-network and the fourth sub-network, and wherein the polarization controller is configured to introduce a desired variation in polarization properties of beams associated with said external interface antenna ports, the method further comprising:

using the polarization controller to control the polarization orthogonality along at least one of (i) the sector borders of said first sectors and (ii) within said first sectors by selecting the control parameters appropriately; and changing, using a configuration network, the number of first sectors to form a number of second sectors.

26. The antenna arrangement according to claim 1, wherein each of the third sub-network and the fourth sub-network is a butler matrix that combines signals having different polarizations among themselves.

27. The method according to claim 21, wherein each of the two sub-networks is a butler matrix that combines signals having different polarizations among themselves.

28. The method according to claim 25, wherein each of the third sub-network and the fourth sub-network is a butler matrix that combines signals that have different polarizations among themselves.

* * * * *